US008157240B2

(12) United States Patent
Kaneko et al.

(10) Patent No.: US 8,157,240 B2
(45) Date of Patent: Apr. 17, 2012

(54) QUAKEPROOF PLINTH TO SHELTER A SHOWPIECE THEREON

(75) Inventors: Tomonao Kaneko, Tsurugashima (JP); Noboru Yamane, Hanno (JP)

(73) Assignees: Musashi Co., Ltd., Saitama (JP); Kohichi Murakoshi, Saitama (JP)

( * ) Notice: Subject to any disclaimer, the term of this patent is extended or adjusted under 35 U.S.C. 154(b) by 496 days.

(21) Appl. No.: 12/382,115

(22) Filed: Mar. 9, 2009

(65) Prior Publication Data

US 2009/0256049 A1 Oct. 15, 2009

(30) Foreign Application Priority Data

Apr. 15, 2008 (JP) ..... 2008-106161

(51) Int. Cl.
*F16M 9/00* (2006.01)

(52) U.S. Cl. ..... 248/638; 248/562; 312/114; 312/117; 267/136; 318/649

(58) Field of Classification Search ..... 267/136, 267/137, 140.11, 562; 248/638, 636, 564; 318/649; 52/167.6

See application file for complete search history.

(56) References Cited

U.S. PATENT DOCUMENTS

| | | | | | |
|---|---|---|---|---|---|
| 4,112,776 | A * | 9/1978 | Ouellette et al. | ..... | 73/665 |
| 4,367,087 | A * | 1/1983 | Cardenas Franco et al. | ... | 65/163 |
| 4,749,241 | A * | 6/1988 | Thoresen et al. | ..... | 312/114 |
| 4,801,122 | A * | 1/1989 | Stahl | ..... | 248/636 |
| 5,035,394 | A * | 7/1991 | Haak | ..... | 248/562 |
| 5,127,718 | A * | 7/1992 | Paine et al. | ..... | 312/114 |
| 5,913,503 | A * | 6/1999 | Satoh et al. | ..... | 248/636 |
| 6,412,890 | B1 * | 7/2002 | Kaneko et al. | ..... | 312/117 |
| 7,992,847 | B2 * | 8/2011 | Kaneko et al. | ..... | 267/136 |

FOREIGN PATENT DOCUMENTS

| | | |
|---|---|---|
| JP | 09-051827 | 2/1997 |
| JP | 2001-231665 | 8/2001 |
| JP | 2003-259945 A | 9/2003 |
| JP | 2006-296792 A | 11/2006 |
| JP | 2007-222481 | 9/2007 |

* cited by examiner

*Primary Examiner* — Rita Leykin
(74) *Attorney, Agent, or Firm* — Jacobson Holman PLLC

(57) ABSTRACT

A quakeproof plinth is adapted to make a showpiece mount vertically go down without a tilt so as to cushion and shelter a showpiece seated thereon from impact force exerted on the entire showpiece. A plinth (100) of the present invention is comprised of a showpiece mount (110), a supporting member (120) capable of supporting the showpiece mount so as to move the same upward and downward, basement shock absorbers (130) enabling the showpiece mount to be shock-absorbingly bumped down thereon, a vibration detector (140), and an actuating device (150) activated to move the showpiece mount downward in response to a detection signal produced from the vibration detector.

18 Claims, 7 Drawing Sheets

QUAKEPROOF PLINTH TO SHELTER A SHOWPIECE THEREON

FIELD OF THE INVENTION

The present invention relates to a plinth to shelter a showpiece seated thereon in response to a shake caused externally. More particularly, the present invention relates to a quakeproof plinth to prevent a showpiece thereon from fracturing because of its tumbling or falling down in the event of exhibitions where articles of historically and artistically precious work, expensive chinaware, and/or esthetic handicraft such as glass-art ware are displayed in a museum, a reception room cabinet, or a showcase in a shop or a showroom.

BACKGROUND ART

Fragile articles such as the above-mentioned precious artistic work, left in a cabinet, a whatnot, or a showcase, are prone to tumble or fall down to fracture because of a shake by an earthquake. Usually, the articles are guarded by strained rope or bracing that surrounds the articles. As to a particularly large artwork showpiece, several strings of rope are typically strained and separated by a certain distance from each other. However, such manners are unsatisfactory as a full protection means from articles' tumbling or falling down. They also give esthetically adverse effects as well as bothering obstacles to viewers.

In order to overcome the aforementioned disadvantages, there has been developed an earthquake-proof plinth that comprises a holder supporting a showpiece seated thereon, a sensor for detecting vibration, a releaser receiving a signal from the sensor for making the holder release the showpiece, and a protecting means located under the holder to serve as a drop and shelter to receive and protect the showpiece released from the holder where the releaser includes a solenoid device activated by the signal from the sensor and a stopper disengaged from the holder by means of the solenoid device (see Patent Document 1 listed below).

Another type of the plinth has been disclosed which comprises a base of a certain height with a pair of apertures opposed to each other in the top and bottom plates of the base where the aperture in the top plate can be opened and closed by sliding a pair of shutters that meet each other at the center of the aperture while the bottom plate is skirted around the aperture by a shock-absorbing and volume-adjustable sac with its upper open end fixed to bottom plate so that the sac hangs down and is ready for trap an artistic showpiece fallen from its seated location. This type of the plinths further comprise an actuating device and a vibration sensor, and the vibration sensor detects vibration caused by an earthquake and makes the actuating device move the shutters to leave the aperture open, so as to protect the artistic showpiece from liable damages (see Patent Document 2 listed below).

Still another type of the plinth has an aperture formed in a level flush with a surface of a showpiece mount to follow contours of the middle portion of a showpiece seated thereon, and the plinth comprises a base plate capable of passing vertically through the aperture and supported by a shaft extending vertically downward therefrom, a vibration sensor, a stopper means for shock-absorbingly stopping the base-plate supporting shaft when the showpiece drops till its middle portion becomes fitted in to choke up the aperture in the plinth, and a lock/unlock means for normally locking the base-plate supporting shaft to keep the base plate flush with the surface of the showpiece mount and unlocking the base-plate supporting shaft upon receiving a detection signal from the vibration sensor to let the base-plate supporting shaft drop along with the base plate (see Patent Document 3 listed below).

Patent Document 1: Japanese Patent No. 2746253

Patent Document 2: Japanese Patent No. 3458089

Patent Document 3: Japanese Patent Preliminary Publication No. 2007-222481

In the earthquake-proof plinths as disclosed in Patent Document 1, when the showpiece is released from the holder and gravitationally dropped into the trap with shock-absorbing material such as sponge, the showpiece received at the bottom of the trap is prone to make a large bumping noise or even be damaged. Also, this type of the prior art plinth is not capable of keeping showpiece mount without a tilt, and therefore, the showpiece is prone to have its finished surface, edges, and/or flourishes chipped or cracked upon being gravitationally dropped.

In the earthquake-proof plinth as disclosed in Patent Document 2, the elastic sac is an essential component, and the actuating device for the shutters is complicated in structure. In addition, this type of the prior art plinth encounters difficulties that a showpiece cannot be kept without a tilt on exhibit and that vertical dimensions of the plinth cannot be reduced.

In the prior art plinth as disclosed in Patent Document 3, since the base plate is supported by the shaft, it is hard to keep the showpiece horizontal on exhibit, and it is also hard to reduce vertical dimensions of the plinth. In addition, this type of plinth inevitably has an actuating device complicated in structure.

Accordingly, it is an object of the present invention to provide an earthquake-proof plinth adapted to make a showpiece seated thereon vertically go down instantaneously at the onset of an earthquake so as to buffer impact on the entire showpiece.

It is another object of the present invention to provide an earthquake-proof plinth that is adapted to keep the showpiece seated thereon upright without a tilt and that can ensure a full protection of the showpiece in response to a shake due to an earthquake or the like so as to avoid its tumbling down and being damaged.

It is still another object of the present invention to provide an improved plinth that is compact, easy to install, and reduced in manufacturing cost.

SUMMARY OF THE INVENTION

An earthquake-proof plinth according to the present invention is comprised of a showpiece mount on which a showpiece is seated, a supporting member capable of moving the showpiece mount upward and downward through the same, a shock-absorbing member located at the bottom of and inside of the supporting member to enable the showpiece mount to be shock-absorbingly bumped down thereon, a vibration detector for detecting vibrations exerted on the plinth, and an actuating device moving the showpiece mount downward in response to a detection signal from the vibration detector. Configured in this manner, the plinth can keep the showpiece thereon upright on exhibit, and is capable of assuredly protecting the showpiece from vibration caused by an earthquake. Since the plinth according to the present invention can make the showpiece mount go down along with the showpiece seated upright thereon, the showpiece can avoid tumbling and being damaged, and impact on the entire showpiece can be buffered, which resultantly ensures sheltering the showpiece.

Preferably, the plinth according to the present invention has a shock-absorbing member located at least one of upper and lower major surfaces of the showpiece mount; the shock-absorbing member being of any material compressively deformable upon impact. It is also preferable that the plinth according to the present invention has a shock-absorbing member located at the bottom of and inside of the supporting member on which the showpiece mount is to be bumped down; the shock-absorbing member being of any material compressively deformable upon impact. Configured in this way, the plinth ensures sheltering the showpiece at the onset of vibrations caused by an earthquake or the like.

In the plinth according to the present invention, the actuating device for the showpiece mount includes an actuator capable of rotatably moving the showpiece mount about its center axial line, and a clamp operatively located along the peripheral surface of the supporting member. The plinth according to the present invention preferably has the actuating device for the showpiece mount adapted to move the showpiece mount through the supporting member and rotate the showpiece mount inside the supporting member.

The plinth according to the present invention preferably includes a rotary movement limiting mechanism to limit a rotary movement range of the showpiece mount. Configured in this way, the plinth enables the showpiece mount to move and rotate in a certain limited range.

In the plinth according to the present invention, the supporting member preferably has its inner circumferential surface provided with a protecting member to surround and cushion up a peripheral surface of the showpiece. Configured in this manner, the plinth ensures a full protection of the showpiece, especially, its peripheral surface and edges.

In the plinth according to the present invention, preferably the showpiece mount includes more than one lock bolts, and the supporting member includes bolt abutments against which the lock bolts lean to support the showpiece mount, and bolt guides in which the lock bolts are fitted to guide the showpiece mount downward. In the plinth according to the present invention, the lock bolts protrude radially outward from the showpiece mount, and the bolt abutments are defined as raised portions extending horizontally while the bolt guides are defined as through-holes extending vertically. Configured in this way, the plinth, which normally keep the showpiece thereon upright on exhibit, can make the showpiece mount accurately go down at the onset of vibrations caused by an earthquake or the like.

The present invention also provides a quakeproof plinth for sheltering a showpiece seated thereon in response to shakes, being comprised of a showpiece mount on which a showpiece is seated, a supporting member capable of moving the showpiece mount upward and downward through the same, a shock-absorbing member enabling the showpiece mount to be shock-absorbingly bumped down thereon, and an actuating device moving the showpiece mount downward in response to a detection signal manually input by an operator. Configured in this manner, the plinth according to the present invention, utilizing a nationwide system such as an earthquake warning report from the Japan Meteorological Office, enables the showpiece mount to go down manually to protect the showpiece seated thereon from impact and damage before the predicted arrival time of S wave (i.e., longitudinal wave) succeeding to detected P wave (i.e., transverse wave).

Operating procedures of the plinth according to the present invention will now be outlined. The showpiece mount of the plinth is first moved upward to keep it inside and at the top of the supporting member. A showpiece is then seated on the showpiece mount flush with the top of a block of the plinth. The vibration detector, on detecting vibration of the plinth as a result of a shake due to an earthquake, produces a detection signal, and the showpiece mount is moved downward in response to the detection signal. Receiving the detection signal from the vibration detector, the actuating device is activated. Consequently, the actuating device enables the showpiece mount to go down. The showpiece mount rotates and moves in a range limited by the rotary movement limiting mechanism. After the showpiece mount goes down through the supporting member, the showpiece can assuredly be sheltered behind the shock-absorbing member.

The plinth according to the present invention is advantageous in view of its simplified structure and reduced manufacturing cost. In addition, the plinth of the present invention is easy to handle and assumes an aesthetically satisfactory appearance. The plinth of the present invention enables a showpiece of chinaware or the like to keep upright on exhibit and ensures that it is protected from a shake due to an earthquake. The plinth of the present invention is compact, and therefore, easy to install, without occupying unwanted additional dimensions of the exhibition floor. The plinth of the present invention can keep the showpiece mount without a tilt at the onset of vibration due to an earthquake or the like and instantaneously make the showpiece mount go down along with the showpiece seated upright thereon, avoiding its tumbling down, which can resultantly buffer impact exerted on the entire showpiece.

BRIEF DESCRIPTION OF THE DRAWINGS

FIG. 3(*a*) is a side view of parts of the actuator and a clamp while FIG. 3(*b*) is a side view of parts of a gauge ladder and the clamp.

FIG. 4(*a*), FIG. 4(*b*), and FIG. 4(*c*) are a top plan view, a vertical sectional view, and a bottom view of the showpiece mount, respectively.

DETAILED DESCRIPTION OF THE INVENTION

Best Mode of the Invention

<1. Configuration of Exemplary Showpiece Plinth>

Preferred embodiments of a plinth according to the present invention will now be described in conjunction with the accompanying drawings.

Figure 1:
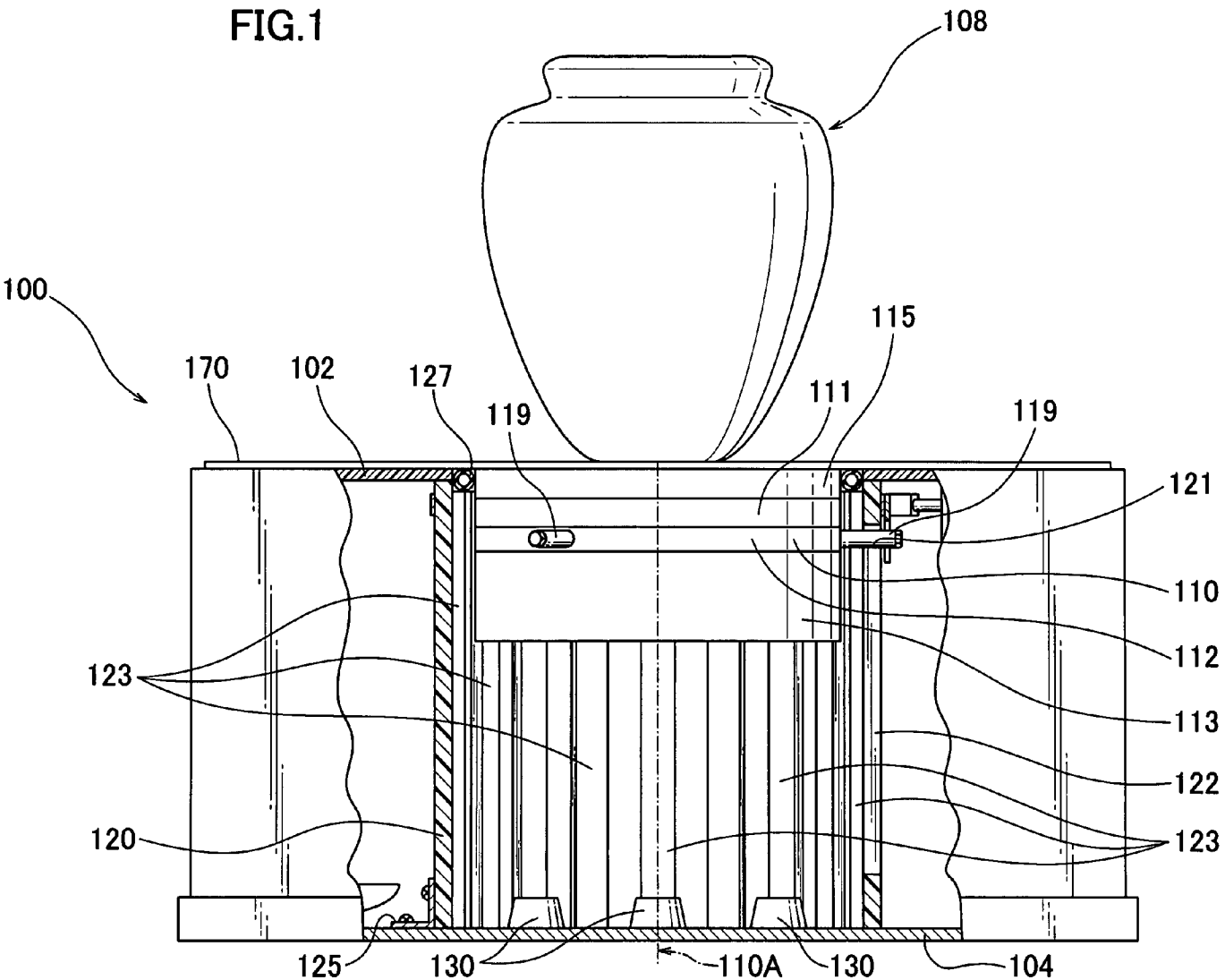
FIG. 1 is a partial cross-sectional view of an embodiment of a quakeproof plinth according to the present invention, especially illustrating a showpiece mount and a supporting member for the same.

Referring to FIG. 1, the plinth 100, which is adapted to shelter a showpiece seated thereon at the onset of a shake due to an earthquake or the like, comprises a block 102 housing components of the plinth, and a bottom plate 104 in the lowest portion of the block 102. The block is a hollow box-shaped table. In FIG. 1, the block 102 has its top plan cross-section shaped in rectangle. The top plan cross-section may be rectangular, polygonal, circular, or any other form defined by at least one of straight and curved lines.

A length of the block 102 may range from 350 to 800 mm. A width of the block 102 may range from 250 to 500 mm. A height of the block 102 may range from 160 to 400 mm. In some preferred embodiments, the block 102 may be 450 mm in length, 375 mm in width, and 220 mm in height. The block 102 may be fixed to the bottom plate 104 by means of angles or without angles, and in the event of the latter, the block 102 is scarfed together with the bottom plate 104.

Figure 2:
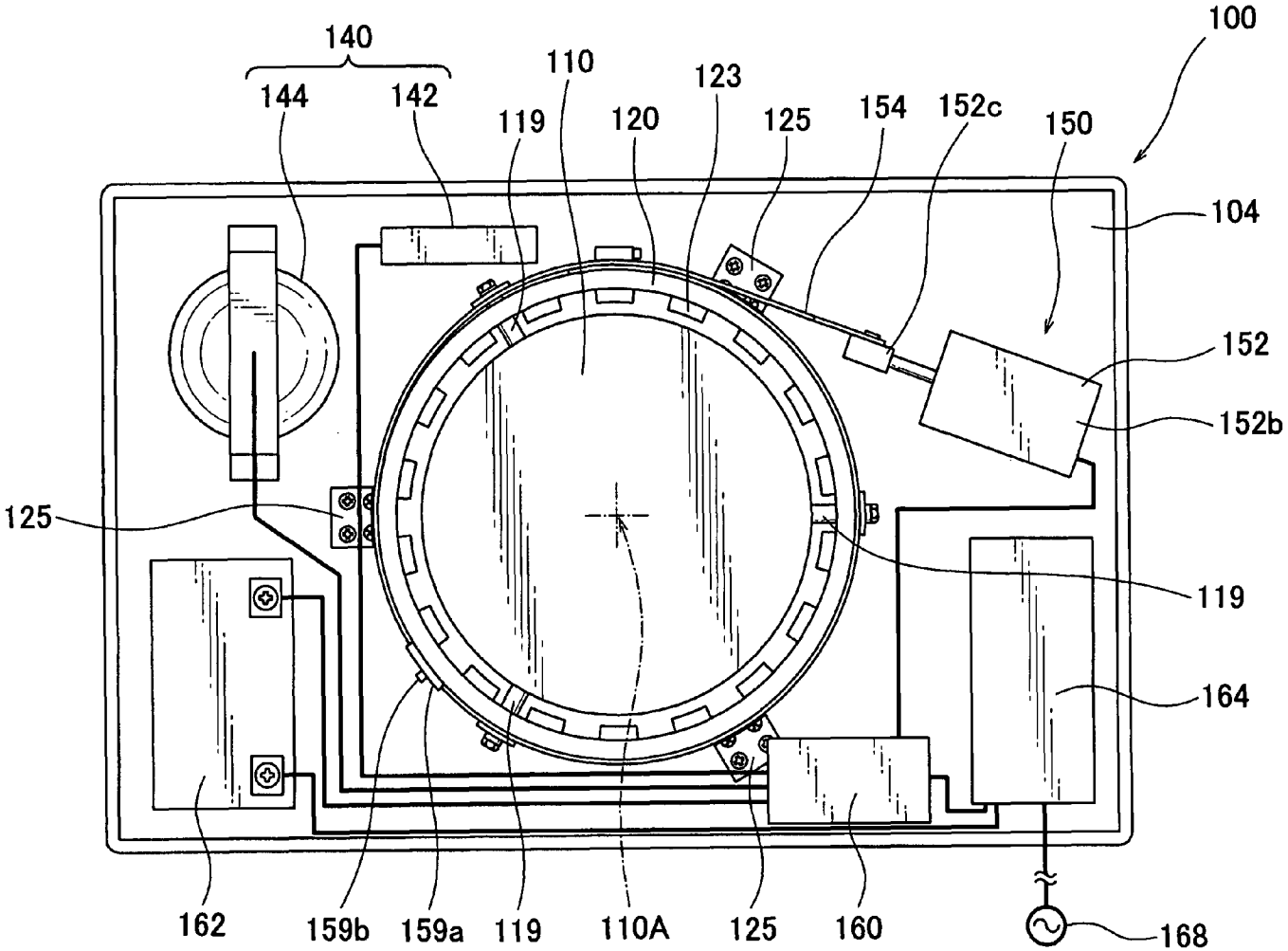
FIG. 2 is a plan view of the exemplary quakeproof plinth, especially schematically illustrating primary components located in positions, with the top of a block of the plinth being removed.

Referring to FIGS. 1 and 2, the plinth 100 includes a showpiece mount 110 on which an article 108 such as chinaware is seated, a supporting member 120 supporting the showpiece mount 110 so as to be movable upward and downward through the same, basement shock absorbers 130 located inside of and at the bottom of the supporting member 120 over the bottom plate 104 so as to permit the showpiece mount 110 to be shock-absorbingly bumped down thereon, a vibration detector 140 detecting a shake exerted on the plinth 100, an actuating device 150 moving the showpiece mount 110 downward in response to a detection signal produced by the vibration detector 140. The showpiece mount 110 is kept horizontal without a tilt, relative to the supporting member 120.

The supporting member 120 may be fixed to the bottom plate 104 by means of a plurality of fixtures (i.e., brackets fixing the supporting member to the on-floor bottom plate) 125. Each of the basement shock absorbers 130 is made of a compressively deformable material that is transformed upon impact. As required, the article 108 is seated on the showpiece mount 110 with a showpiece mount cloth 170 laid therebetween. The showpiece mount cloth 170 may be any of well-known materials such as synthetic fiber, unwoven fabric, and the like.

Figure 4A:
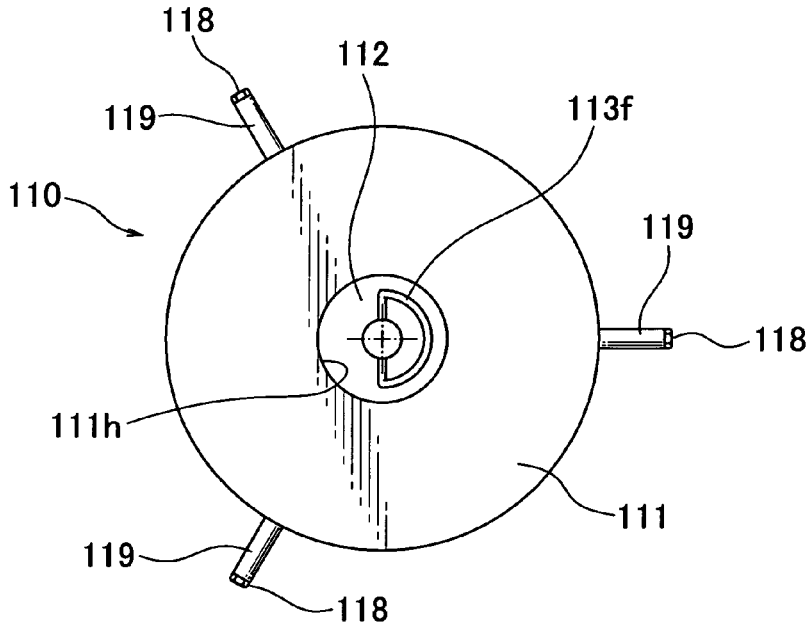
FIG. 4 is a diagram of the exemplary quakeproof plinth, especially illustrating a showpiece mount.
Figure 4B:
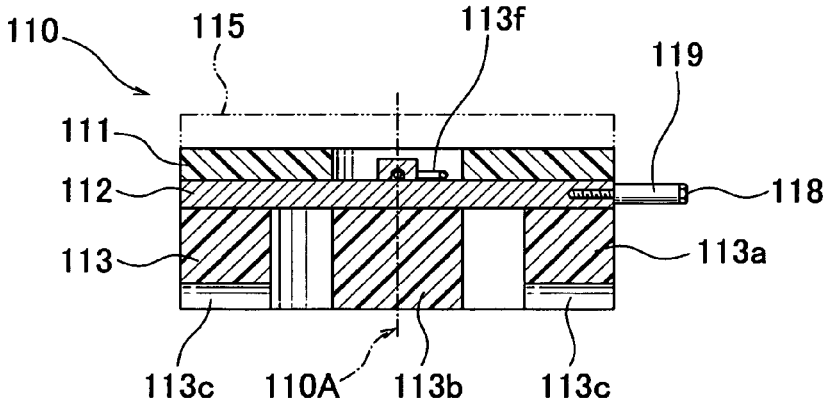
Figure 4C:
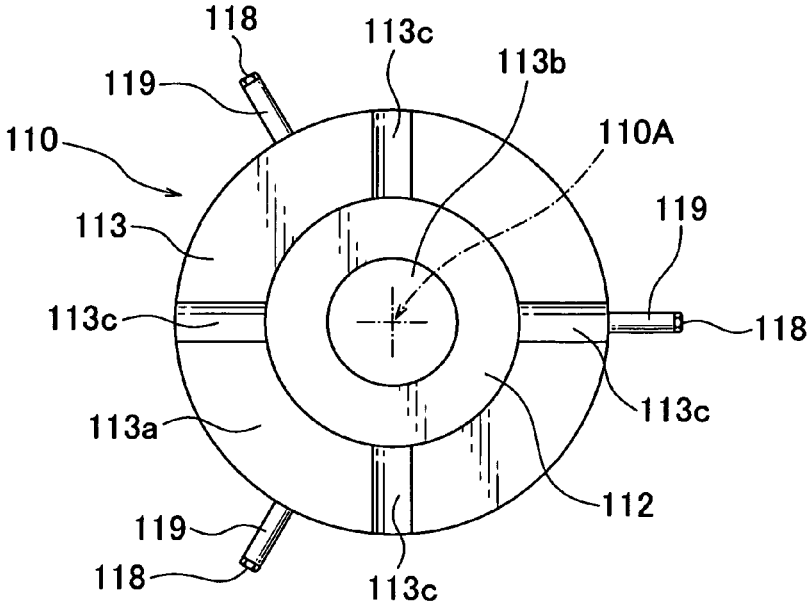

Referring to FIGS. 1 and 4, the showpiece mount 110 is circular in peripheral shape, and center axial line 110A is depicted extending through the very center of the showpiece mount. The showpiece mount 110 has an upper shock-absorbing member 111, an intermediate mount member 112, and a lower shock-absorbing member 113. In the showpiece mount 110, the upper shock-absorbing member 111 serves as a first shock absorber while the lower shock-absorbing member 113 serves as a second shock absorber, both of which protect the showpiece seated on the showpiece mount. Such a shock absorber is preferably located at least one of the upper and lower major surfaces of the showpiece mount 110.

The upper and lower shock-absorbing members 111 and 113 are made of a compressively deformable material that is transformed upon impact. The upper shock-absorbing member 111 is made of a couple of expanded polystyrene discs bonded together. The intermediate mount member 112 is made of plywood. The plywood used herein may be 10 to 60 mm in thickness.

The lower shock-absorbing member 113 may be made of polyester, or otherwise, it may be formed of a piece of expanded polystyrene disc. The upper shock-absorbing member 111 may be 10 to 30 mm in thickness while the lower shock-absorbing member 113 may be 10 to 30 mm in thickness.

The showpiece mount 110 is a lamination body of the upper and lower shock-absorbing members 111 and 113 respectively bonded to the intermediate mount member 112. Configured in this manner, the showpiece mount 110 can effectively protect the showpiece 108, especially its bottom portion, when it is dropped and bumped down at the onset of an earthquake. With the showpiece mount cloth 170, the showpiece 108, when dropped due to the earthquake, can be effectively muffled by and sheltered behind the showpiece mount cloth 170. In this way, the article seated on the showpiece mount, especially, an antique cup dedicated to a traditional tea ceremony, a wood-carved lacquered statue, or the like can have its decorative patterns and/or detailed contours on the peripheral surface protected from being chipped or damaged.

The upper shock-absorbing member 111 has a window 111*h* at its center so that the showpiece mount 110, once dropped down, can be raised to the normal position by grabbing a pop-top ring 113*f* through the window, and the pop-top ring 113*f* may be fixed to the center of the upper major surface of the intermediate mount member 112. A diameter of the window 111*h* may range from 30 to 60 mm, and in one preferred embodiment, it is 35 mm. Alternatively, a pull-up cord may be provided at the center of the upper major surface of the intermediate mount member 112 so that pinching and drawing back the pull-up cord permits the showpiece mount 110 to be raised after it is dropped down on the bottom. As required, a disc-shaped base board 115 may overlie the upper shock-absorbing member 111. The base board 115 may be made of a compressively deformable material that is transformed upon impact. For instance, the base board 115 may be formed of expanded polystyrene, polyester, synthetic rubber, or the like.

The lower shock-absorbing member 113 includes an annular peripheral portion 113*a* and a disc-shaped center portion 113*b*. While the showpiece mount 110 is going down through the supporting member 120, air compressed below the falling showpiece mount 110 is released outward through air ducts 113*c* that are radially defined in the annular portion 113*a*. Although FIG. 4 depicts four of the air ducts 113*c*, there may alternatively be one, two, or three of the air ducts 113*c*.

Referring to FIG. 1, there are more than one of the basement shock absorbers 130 over an upper major surface of the bottom plate 104. The basement shock absorbers 130 are made of a compressively deformable material that is transformed upon impact. A thickness of each of the basement shock absorbers 130 may range, for example, from 10 to 50 mm. A diameter of each of the basement shock absorbers 130 may range, for example, from 10 to 80 mm. The basement shock absorbers 130 function to buffer impact caused by the showpiece mount 110 bumped down thereon and diminish noise of the impact.

Although the embodiment shown has four of the basement shock absorbers 130 (only three of them can be seen), there may alternatively three, four or more of them. Preferably, the number of the basement shock absorbers 130 is determined so as to coincide with that of air ducts 113*c*. Positions of the basement shock absorbers 130 are preferably determined so as not to coincide with those of the air ducts 113*c*. Configured in this manner, the plinth can effectively protect the showpiece 108 seated thereon, especially, its bottom portion, when the showpiece mount 110 along with the showpiece 108 is bumped down.

With reference to FIG. 1, the supporting member 120 may be made, for instance, of vinyl chloride pipe that is 200 mm in inner diameter and 220 mm in height. The pipe used may be that which is as thick as 3 to 10 mm. In order to protect the peripheral surface of the showpiece, the supporting member 120 has a bumper 123 affixed over the inner surface. The bumper 123 may be a plurality of longitudinal strips serving as a protecting element. The bumper 123 is made of a compressively deformable material that is deformed upon impact.

The bumper 123 may be formed, for example, of elongated strips of sponge having a thickness of 1 to 5 mm. It is preferable that the supporting member 120, once the bumper 123 is bonded thereto, has its inner surface spaced 1 to 5 mm apart from the disc edge of the showpiece mount 110.

The bumper 123 may be formed, for example, of elongated strips of sponge having a width of 10 to 30 mm. For instance, 4 to 30 strips of the bumper 123 may be used. These strips of the bumper 123 are vertically disposed in parallel with and spaced from one another. In the embodiment of such bumper arrangement, the showpiece mount along with the showpiece is dropped by 150 mm in response to a shake due to an earthquake. Configured in this manner, the plinth can effectively protect the showpiece 108 dropped at the onset of an earthquake from tumbling down and being damaged, and additionally, the plinth can effectively shelter the showpiece 108 behind the surrounding shock absorbers from impact exerted on its peripheral surface.

The strips of the dumper 123 may be bonded to the inner surface of the supporting member 120. Additional shock absorber 127 such as sponge band, rubber hose, or the like may be affixed to the supporting member 120 circularly along the upper rim. An inner diameter of the supporting member 120 with the dumper 123 bonded thereto may be determined, allowing for contours (i.e., an outer diameter) of the showpiece 108 to be seated on the plinth. A distance by which the showpiece 108 can be dropped may be determined, allowing for a profile (i.e., a height) of the showpiece 108.

Figure 3A:
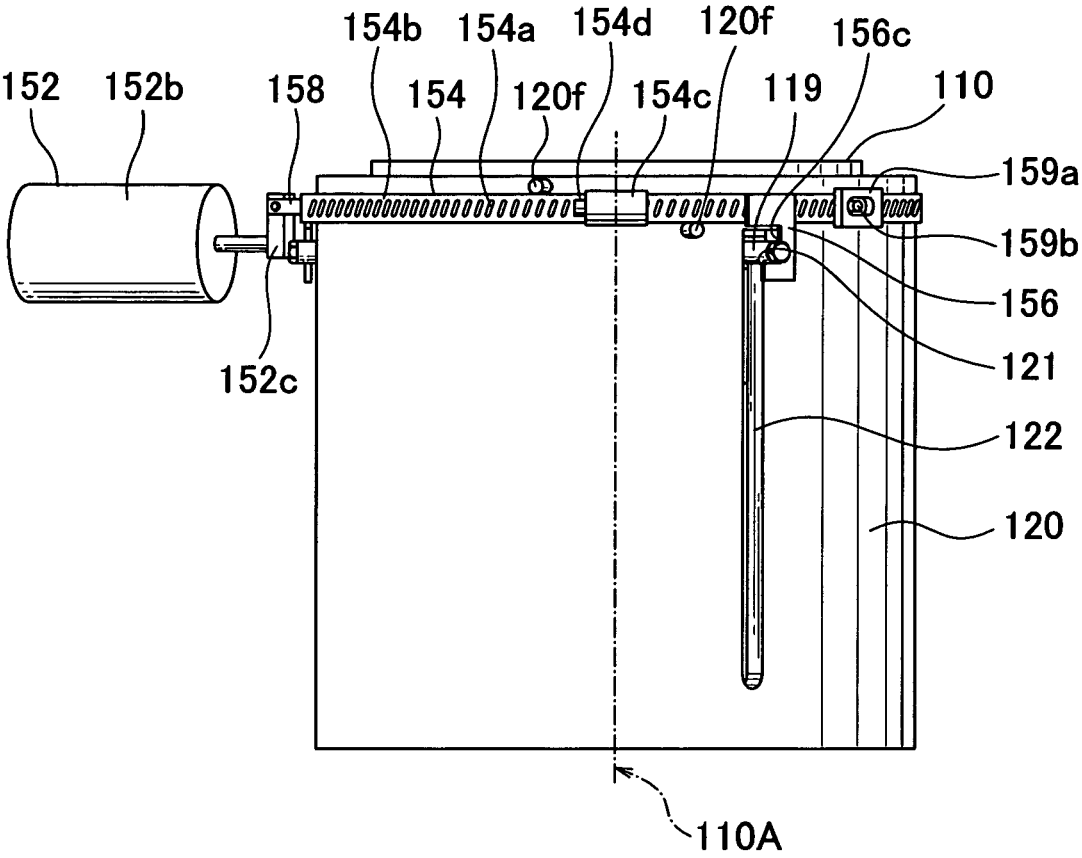
FIG. 3 is a side view of the exemplary quakeproof plinth, especially illustrating an actuator.
Figure 3B:
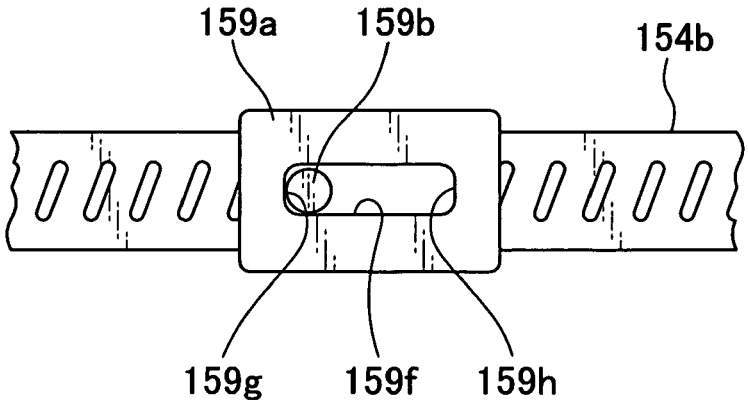

Referring to FIGS. 2 and 3, the actuating device 150 for the showpiece mount has an actuator 152 capable of moving the showpiece mount 110 through the supporting member 120 and rotating the showpiece mount 110 about the center axial line 110A, and a control unit 160 including a control circuit to control the actuator 152. A clamp 154 is located on the peripheral surface of the supporting member 120 so as to rotatably move the showpiece mount 110 about the center axial line 110A.

With reference to FIGS. 1 to 3, the showpiece mount 110 is provided with a plurality of lock bolts 118. The lock bolts 118 protrude radially outward from the intermediate mount member 112 in horizontal directions. The lock bolts 118 are respectively bushed as denoted by a reference numeral 119. FIG. 2 depicts an embodiment where there are three of the lock bolts 118, and alternatively, there may be three, four or more of the lock bolts 118. The supporting member 120 has lock bolt abutments 121 against which the lock bolts 118 lean to support the showpiece mount 110, and lock bolt guides 122 in which the lock bolts 118 are fitted to guide the showpiece mount downward. The lock bolt abutments 121 are defined as raised portions horizontally extending in the supporting member 120. The lock bolt guides 122 are defined as through-holes vertically extending in the supporting member 120.

Referring to FIGS. 2 and 3, the actuator 152 includes a main actuator portion 152*b* housing a driving magnet, and an actuator axle 152*c*. The actuator 152 may be comprised of a motor(s) and gears. The clamp 154 has a metal clamp band 154*b* shaped like a gauge ladder with graduated scale slits 154*a* for adjusting a dimension. Attached to the clamp band 154*b* are clamp lock 154*c* and a clamp adjustment bolt 154*d*, which are used to fix the determined dimension. The clamp band 154*b* can be revolved relative to the peripheral surface of the supporting member 120 in a horizontal plane.

A plurality of catch bolts 120*f* are provided along the peripheral surface of the supporting member 120 to prevent the clamp band 154*b* from creeping. Part of the catch bolts 120*f* are stuck to abut against the upper edge of the clamp band 154*b* while the remaining catch bolts 120*f* are to abut against the lower edge of the same. The catch bolts 120*f* guard the clamp band 154*b* so as to leave it revolvable relative to the peripheral surface of the supporting member 120. Also, attached to the clamp band 154*b* is a lock-bolt release 156 that comes in contact with each of the lock bolts 118 to release and rotatably moves the showpiece mount 110. A contact 156*c* of the lock-bolt release 156 is adapted to touch the periphery of each of the lock bolt 118.

The clamp band 154*b* has its end coupled to the actuator axle 152*c* by a coupler 158. The coupler 158 is comprised of a tension axis connected to the actuator axle 152*c*, and a tension wire connecting the tension axis to the end of the clamp band 154*b*. In addition, a rotary movement limiting mechanism is provided to limit a rotary movement range of the showpiece mount 110. The rotary movement limiting mechanism is comprised of a range plate 159*a* attached to the clamp band 154*b*, and a pin 159*b* located in the peripheral surface of the supporting member 120. For the purpose of attaching the range plate 159*a* to the clamp band 154*b*, preferably a repulsive rubber member (not shown) is laid between them. A horizontal slit 159*f* is defined in the range plate 159*a*. The pin 159*b* protrudes through a void of the horizontal slit 159*b* to limit a rotary movement range of the showpiece mount 110 to a lateral dimension defined between the opposite extremes 159*g* and 159*h* of the horizontal slit 159*f*.

The plinth 100 further includes a control unit 160 with a control circuit to control the actuating device 150, a rechargeable battery 162, and a battery charger 164. The battery charger 164 is connected to an external power supply 168 such as an AC power source. The control unit 160 is also provided with a reset switch, fuse, and connection terminals connectable to other showpiece mounts similar to the showpiece mount 110. The actuating device 150 may have its power supply built therein or externally located as a separate power source. For instance, an external power source and/or a battery, connected to the plinth 100 by cable, may be used.

The control circuit can be comprised of ICs and various electric devices. The control circuit may be housed in the block 102 of the plinth 100 or externally located as a separate unit. For instance, the control circuit may be replaced with a general-purpose computer or a personal computer connected to the plinth 100 by cable, or otherwise, a wireless communication device may be used to make such computers run cooperatively with the plinth 100.

The vibration detector 140 may be adapted to include a vibration sensor well known in the art. In some preferred embodiments, the vibration detector 140 includes a sensor 142 detecting longitudinal oscillation and a sensor 144 detecting transverse oscillation. Sensors available for such oscillation sensing may be of a type responding to a tilt of a pendulum to turn on a reed switch, a type emitting laser light to detect varied reflection angles or a cutoff of the light due to a variation in liquid level at the onset of an earthquake, a limit switch type activated by a fluctuation of permanent magnet caused by the variation in liquid level, or any of other oscillation sensors well known in the art.

The control circuit includes a signal receiver receiving a detection signal from the vibration detector 140, and a drive-controlling unit responding to the operation of the signal receiver to control the actuating device 150. The control circuit may rely on an external power supply 168 or otherwise on the battery 162. In order to ensure a continual operation in case of power out, the control circuit preferably keeps the battery 162 on standby while the battery 162 is able to be recharged by the battery charger 164. Alternatively, the control circuit may have a power supply controller that enables the control circuit to be normally powered by the external power supply 168 and switched only during power out to be powered by the battery 162.

<2. Operation of Exemplary Showpiece Plinth>

Figure 5:
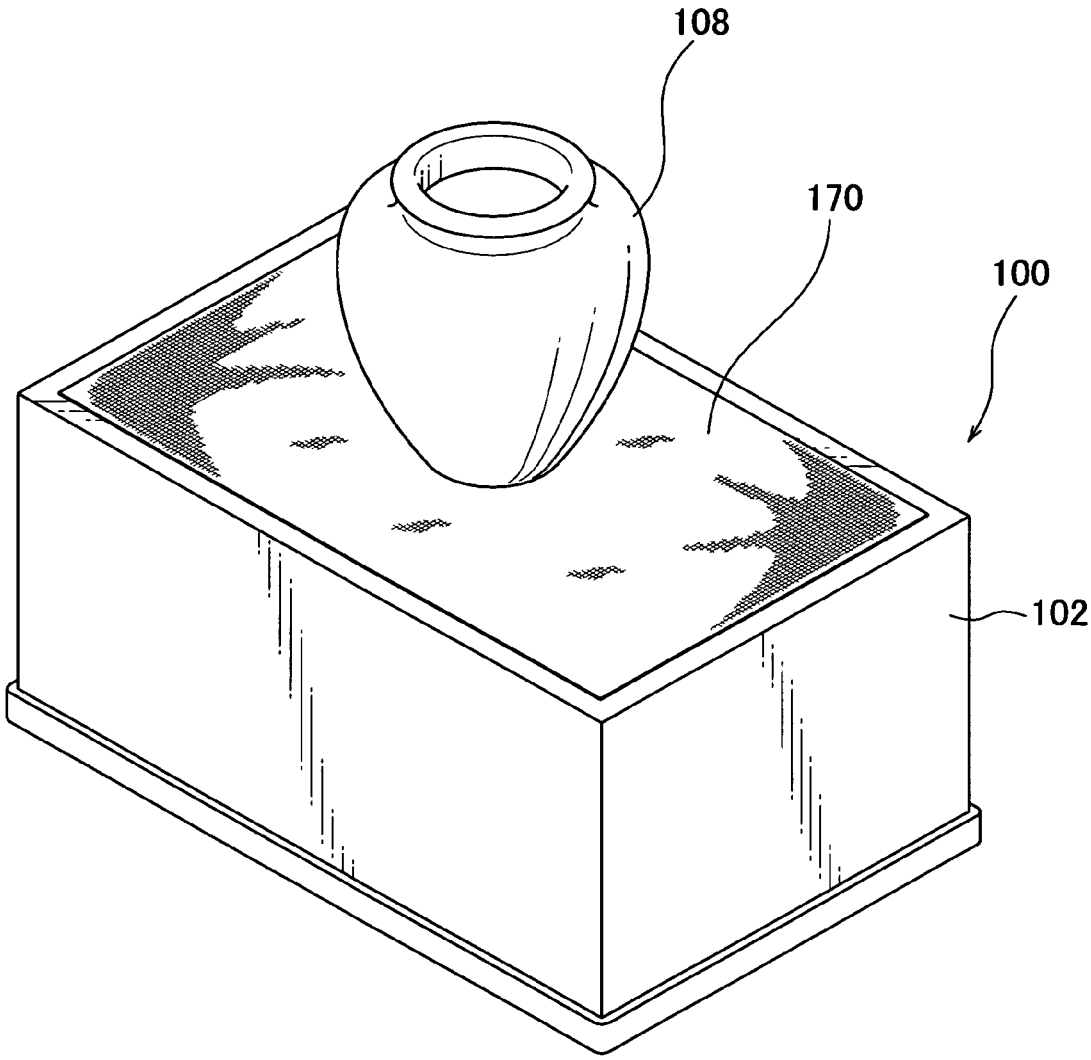
FIG. 5 is a perspective view of the exemplary plinth, especially illustrating a showpiece seated on the showpiece mount.

An operation of the plinth according to the present invention will now be described in conjunction with FIGS. 1, 2 and 5. The power supply (including the charger 164 and the battery 162) for the plinth 100 is made ready to use, and turning on a switch (not shown) causes the actuating device 150 to get set in its initial position. The pop-top ring 113*f* is flipped up and then grabbed to draw back the showpiece mount 110 upward, and then the lock bolts 118 are leaned against the abutments 121 so that the showpiece mount 110 is supported inside the supporting member 120 at its top. The showpiece mount 110 is held horizontal relative to the supporting member 120. The showpiece mount cloth 170 is laid, so that it spreads over the top of the block 102 and the showpiece mount 110 between the showpiece 108 and the showpiece mount 110. The showpiece 108 such as chinaware is seated on the upper major surface of the showpiece mount 110.

When the vibration detector 140 senses a shake exerted on the plinth at the onset of an earthquake, the actuating device 150 moves the showpiece mount 110 downward in response to a detection signal from the vibration detector 140. Specifically, when the signal receiver works upon receiving the detection signal from the vibration detector 140 in the drive controller of the control circuit in the actuating device 150, the actuator 152 is activated in response to that. Once the driving magnet is activated, the actuator axle 152*c* is shifted to revolve the clamp 154 relative to the peripheral surface of the supporting member 120 in a horizontal plane. As the clamp 154 revolves, the contact 156*c* provided in the lock-bolt release 156 touches the periphery of each of the lock bolts 118 to rotate the showpiece mount 110. As the showpiece mount 110 rotates, the lock bolts 118 are respectively dropped and fitted in the lock bolt guides 122 to guide the showpiece mount 110 downward. The lock bolts 118 sliding in the lock bolt guides 122 permit the showpiece mount 110 to go down along with the showpiece seated thereon. The showpiece mount 110 has its rotary movement limited by the range plate 159*a* and the pin 159*b*.

Figure 6:
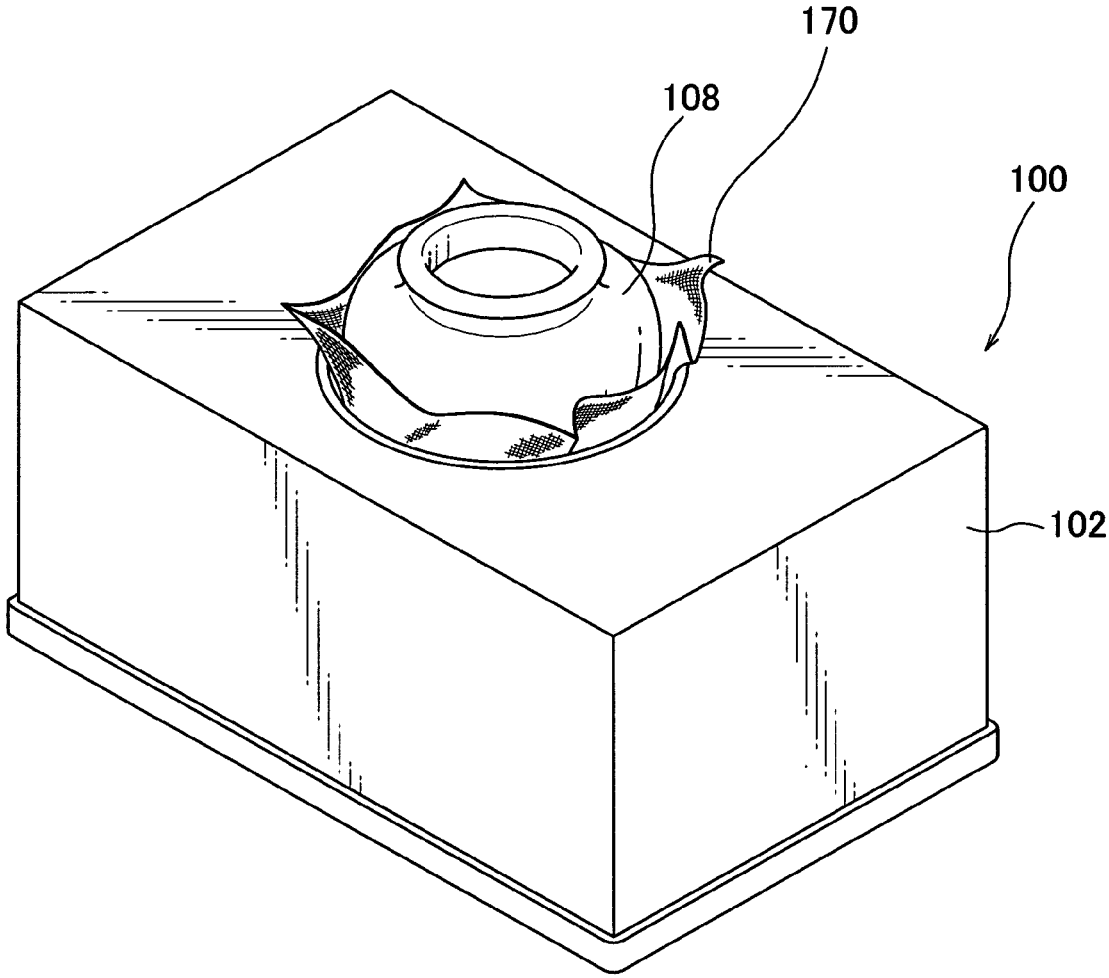
FIG. 6 is a perspective view of the exemplary plinth, especially illustrating the showpiece mount going down.
Figure 7:
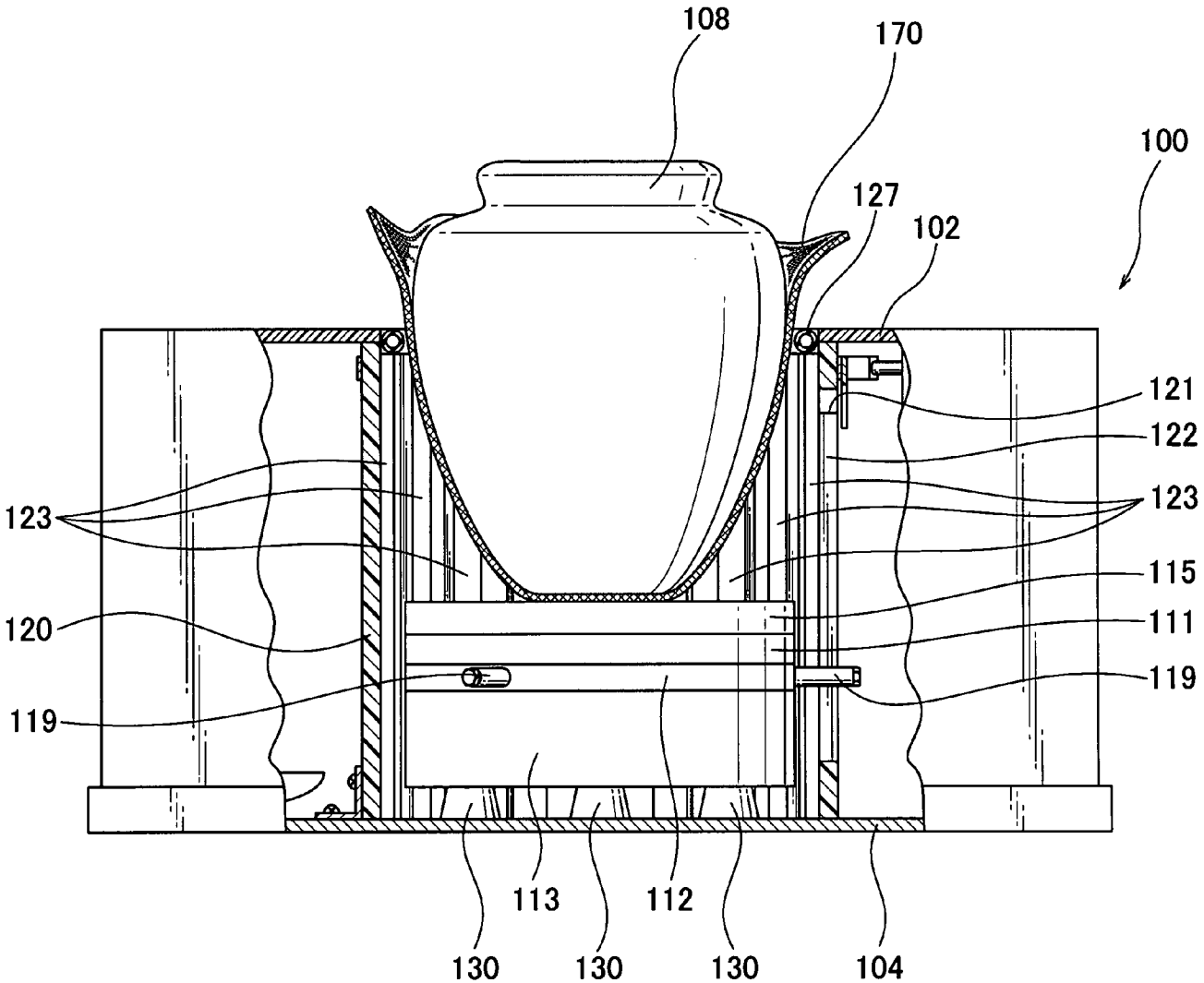
FIG. 7 is a partial sectional view of the exemplary plinth, especially illustrating the showpiece mount going down.

Referring to FIGS. 6 and 7, as the showpiece mount 110 without a tilt, along with the showpiece 108 seated upright thereon, goes down through the supporting member 120, the showpiece mount 110 has its lower shock-absorbing member 113 bumped against the basement shock absorbers 130. The showpiece 108 of which bottom and peripheral surfaces muffled by the showpiece mount cloth 170 is thus sheltered behind the supporting member 120. Since the upper and lower shock-absorbing members 111, 113, and the basement shock absorbers 130 are made of a compressively deformable material that is transformed upon impact, the showpiece is assuredly protected, especially, at its bottom portion. Since the base board 115 is also made of a compressively deformable material that is deformed on impact, the showpiece 108 is further protected especially at its bottom. The bumper 123 is also made of a compressively deformable material that is deformed on impact, and therefore, the showpiece 108 has its peripheral surface effectively protected while it is being dropped.

Once it has found the earthquake ceased safe, the showpiece 108 together with the showpiece mount cloth 170 is removed from the block of the plinth. Then, turning on a switch (not shown) permits the actuating device 150 to return to its initial position. After that, the base board 115 is removed to access and flip up the pop-top ring 113*f*, and further after pinching the pop-top ring 113*f* with fingers to raise the showpiece mount 110, the lock bolts 118 are respectively leaned against the abutments 121 so that the showpiece mount 110 is supported inside the supporting member 120 at its top. The showpiece mount cloth 170 is spread over the top of the block 102 and the showpiece mount 110 so as to be laid between the showpiece 108 and the showpiece mount 110. Eventually, the showpiece 108 such as chinaware is re-seated on the upper major surface of the showpiece mount.

Another embodiment of the present invention utilizes a nationwide system that the Japan Meteorological Office has recently developed where it issues an earthquake warning report of the predicted arrival time of S wave (i.e., longitudinal wave) succeeding to detected P wave (i.e., transverse wave). The system can be validated in the plinth of the present invention if it is modified so as to be workable by shifting for a manual operation, and this results in the showpiece mount being manually enabled to go down and protect the showpiece seated thereon from impact and damage before the predicted arrival of S wave (i.e., longitudinal wave).

With the plinth according to the present invention, a showpiece like an artwork seated thereon on exhibit can be assuredly protected from tumbling down and/or being damaged by means of making the showpiece mount go down to shelter the showpiece behind the plinth. The plinth of the present invention is compact, and hence, it can be set in the existing exhibition cabinets in museums and art galleries without difficulty.

What is claimed is:

1. A quakeproof plinth that cushions and shelters a showpiece seated thereon in response to a shake caused externally, comprising: a supporting member, a showpiece mount having upper and lower major surfaces, a showpiece being seated on the upper major surface, wherein the showpiece mount is supported by the supporting member and is movable upward and downward therethrough, a shock-absorbing member enabling the showpiece mount to be shock-absorbingly bumped down thereon, and an actuating device activated to move the showpiece mount downward in response to a vibration detection signal, wherein the actuating device includes an actuator capable of rotatably moving the showpiece mount about a center axis line of the showpiece mount, and a clamp located along the peripheral surface of the supporting member.

2. The quakeproof plinth according to claim 1, wherein the shock-absorbing member is made of a compressively deformable material that is deformed on impact, and the shock-absorbing member is located over at least one of the upper and lower major surfaces of the showpiece mount.

3. The quakeproof plinth according to claim 1, further comprising a basement shock absorber made of a compressively deformable material that is deformed on impact, the basement shock absorber being located inside the supporting member at its bottom so as to enable the showpiece mount to be shock-absorbingly bumped down thereon.

4. The quakeproof plinth according to claim 1, wherein the supporting member has a protecting member located on its inner circumferential surface for cushioning the showpiece from impact exerted on its peripheral surface.

5. The quakeproof plinth according to claim 1, further comprising a vibration detector for detecting vibrations exerted on the plinth, wherein the actuating device is activated in response to a vibration detection signal produced from the vibration device.

6. The quakeproof plinth according to claim 1, wherein the actuating device is activated in response to a vibration detection signal manually input by an operator.

7. The quakeproof plinth according to claim 2, wherein the actuating device is adapted to rotatably move the showpiece mount inside the supporting member.

8. The quakeproof plinth according to claim 7, further comprising a mechanism for limiting a rotary movement of the showpiece mount within a certain range.

9. The quakeproof plinth according to claim 7, further comprising a vibration detector for detecting vibrations exerted on the plinth, wherein the actuating device is activated in response to a vibration detection signal produced from the vibration device.

10. The quakeproof plinth according to claim 7, wherein the actuating device is activated in response to a vibration detection signal manually input by an operator.

11. The quakeproof plinth according to claim 7, further comprising a basement shock absorber made of a compressively deformable material that is deformed on impact, the basement shock absorber being located inside the supporting member at its bottom so as to enable the showpiece mount to be shock-absorbingly bumped down thereon.

12. The quakeproof plinth according to claim 7, wherein the supporting member has a protecting member located on its inner circumferential surface for cushioning the showpiece from impact exerted on its peripheral surface.

13. A quakeproof plinth that cushions and shelters a showpiece seated thereon in response to a shake caused externally, comprising:

a showpiece mount having upper and lower major surfaces, a showpiece being seated on the upper major surface, wherein the showpiece mount has a plurality of lock bolts, the lock bolts extending radially outward from the showpiece mount, the bolt abutments;

a supporting member through which the showpiece mount is movable upward and downward, wherein the supporting member has bolt abutments against which the lock bolts are leaned to support the showpiece mount, and bolt guides in which the lock bolts are fitted to guide the showpiece mount downward, the bolt abutments being defined as raised portions extending horizontally, and the bolt guides being defined as through-holes extending vertically;

a shock-absorbing member enabling the showpiece mount to be shock-absorbingly bumped down thereon; and an actuating device activated to move the showpiece mount downward in response to a vibration detection signal.

14. The quakeproof plinth according to claim 13, further comprising a vibration detector for detecting vibrations exerted on the plinth, wherein the actuating device is activated in response to a vibration detection signal produced from the vibration device.

15. The quakeproof plinth according to claim 13, wherein the actuating device is activated in response to a vibration detection signal manually input by an operator.

16. The quakeproof plinth according to claim 13, wherein the shock-absorbing member is made of a compressively deformable material that is deformed on impact, and the shock-absorbing member is located over at least one of the upper and lower major surfaces of the showpiece mount.

17. The quakeproof plinth according to claim 13, further comprising a basement shock absorber made of a compressively deformable material that is deformed on impact, the basement shock absorber being located inside the supporting member at its bottom so as to enable the showpiece mount to be shock-absorbingly bumped down thereon.

18. The quakeproof plinth according to claim 13, wherein the supporting member has a protecting member located on its inner circumferential surface for cushioning the showpiece from impact exerted on its peripheral surface.

* * * * *